US005291746A

United States Patent [19]

Abbott

[11] Patent Number: 5,291,746

[45] Date of Patent: Mar. 8, 1994

[54] CONTAINER FOR STORAGE, COLLECTION AND TRANSPORTATION OF MEDICAL WASTE

[76] Inventor: Derwood C. Abbott, P.O. Box 331, Henderson, Tex. 75652

[21] Appl. No.: 28,977

[22] Filed: Mar. 10, 1993

[51] Int. Cl.[5] ..... F23D 3/02

[52] U.S. Cl. ..... 62/89; 62/405; 62/457.9; 62/DIG. 16; 414/420; 414/421; 414/422; 414/608

[58] Field of Search ..... 62/457.1, 457.9, 405, 62/DIG. 16, 89; 414/419–422, 607, 608

[56] References Cited

U.S. PATENT DOCUMENTS

| | | | |
|---|---|---|---|
| 556,198 | 3/1996 | Morse | 62/405 X |
| 1,412,687 | 4/1922 | Knutson | 62/405 |
| 3,514,969 | 6/1970 | Harza | 62/341 |
| 3,650,120 | 3/1972 | Harza | 62/62 |
| 4,044,569 | 4/1977 | Harza | 62/341 |
| 4,220,014 | 9/1980 | Connors | 62/239 |
| 4,561,262 | 12/1985 | Fredrixon | 62/62 |
| 4,825,666 | 5/1989 | Sara, III | 62/457.1 X |
| 4,845,957 | 7/1989 | Richardson | 62/457.9 X |
| 4,928,501 | 5/1990 | Negishi | 62/406 |
| 4,958,506 | 9/1990 | Guilhem | 62/457 |
| 4,995,243 | 2/1991 | Ward | 62/DIG. 16 |
| 5,029,450 | 7/1991 | Takano | 62/239 |

*Primary Examiner*—William E. Tapolcai
*Attorney, Agent, or Firm*—Douglas H. May

[57] ABSTRACT

A refrigerated container for receiving, storing, and transporting materials without necessity of personnel contacting the materials after deposit in the container. The container is particularly adapted for use with medical wastes which may contain infectious materials. The container comprises a lower portion and a lid portion. The container lower portion includes an open-topped inner box for holding waste materials, and an open-topped insulated outer box surrounding and spaced apart from the inner box forming an annular space therebetween. The lid is releasably attached to the outer box and has doors for access into the inner box of the container. A refrigeration unit and air circulation fan are attached to the lid, and are in communication with the annular space for cooling the inner box by circulating refrigerated air through the annular space. The lower portion of the container is attached to a lifting member by a hinge and a releasable latch, such that when the latch is engaged, the container may be lifted in a horizontal position. When the latch is disengaged, the container, when lifted, will rotate about the hinge into an inverted position with the open top of the inner box facing downward.

9 Claims, 5 Drawing Sheets

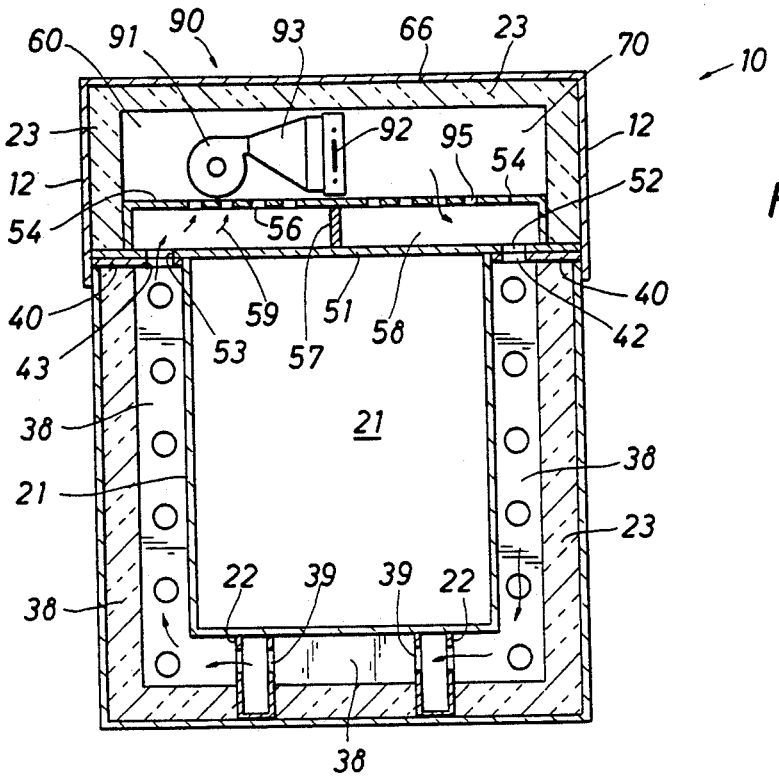
FIG. 3
FIG. 4
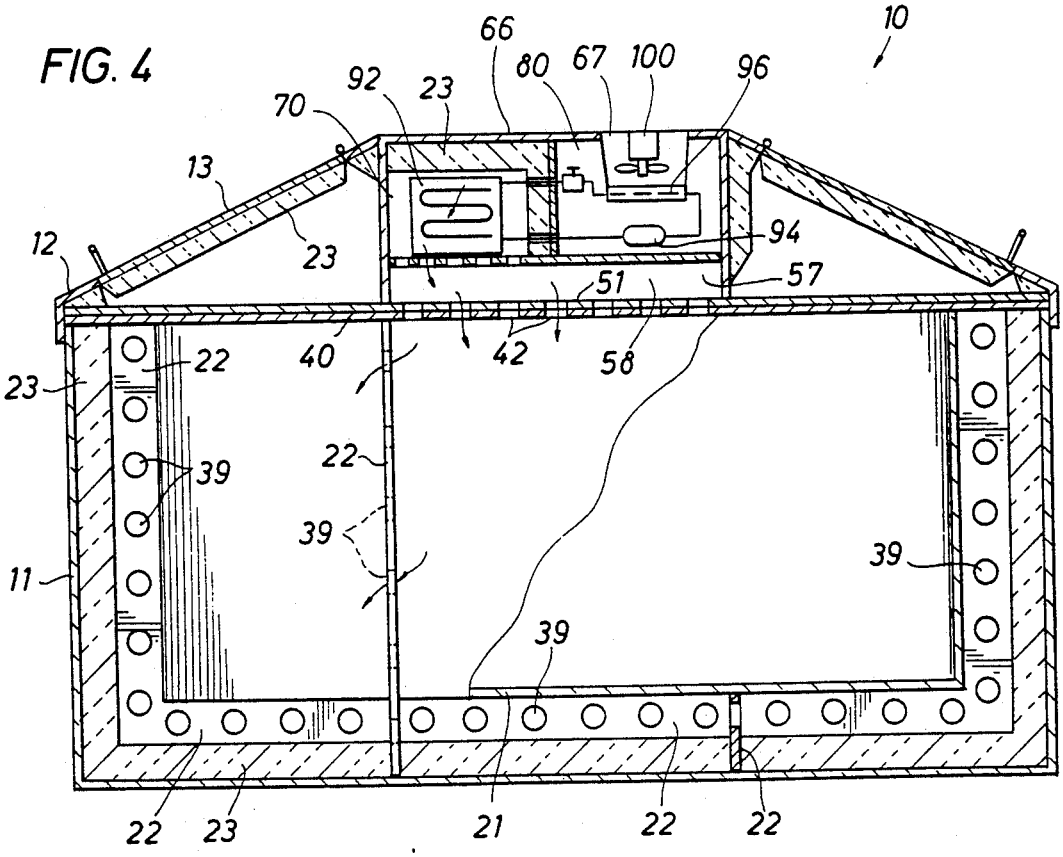

FIG. 5A
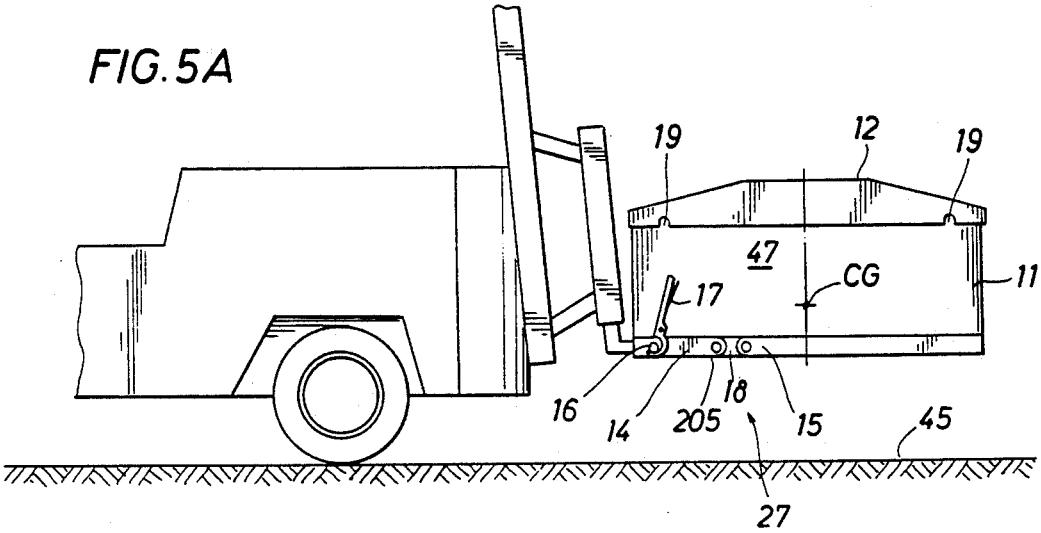
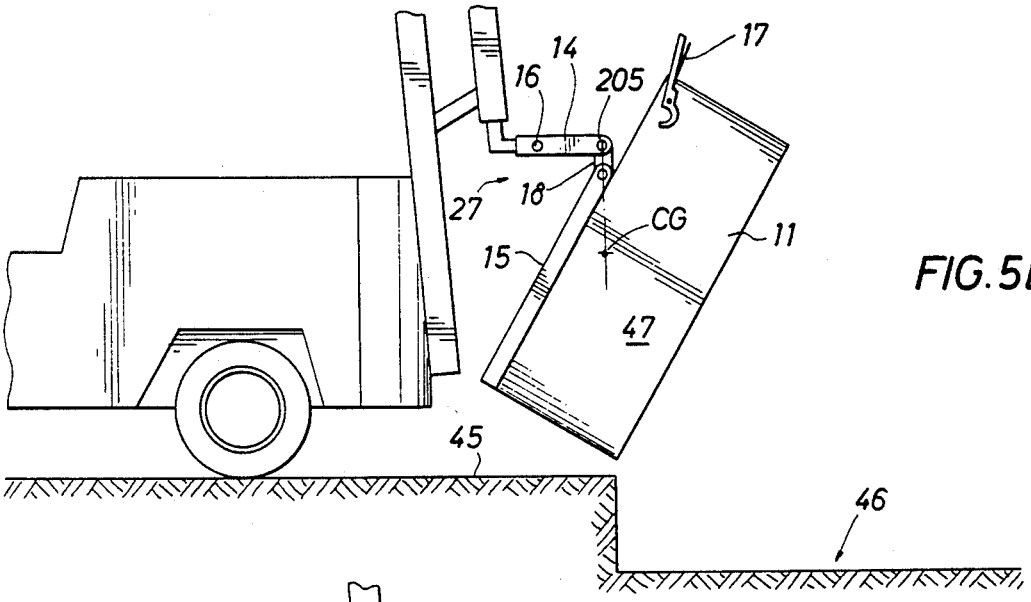
FIG. 5B
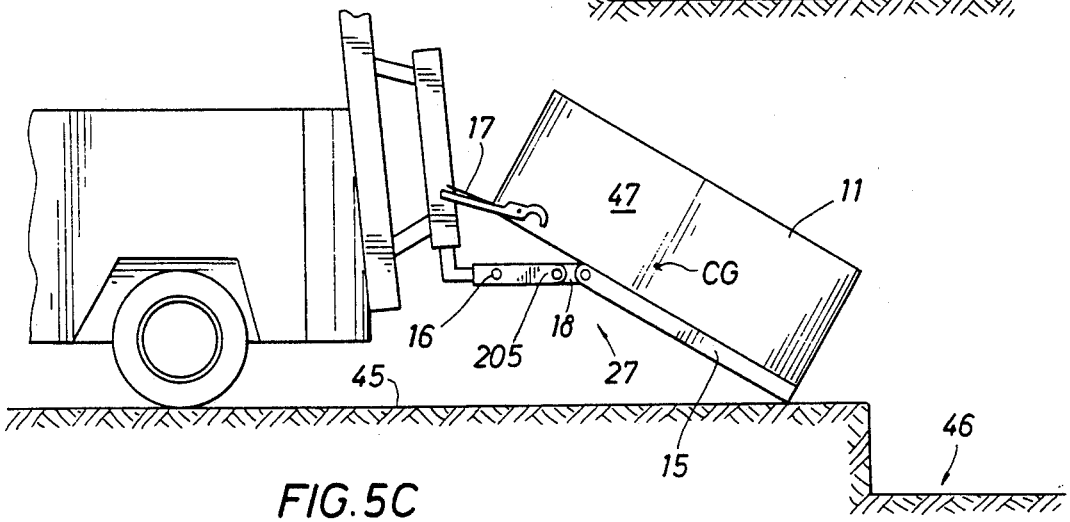
FIG. 5C

CONTAINER FOR STORAGE, COLLECTION AND TRANSPORTATION OF MEDICAL WASTE

BACKGROUND OF THE INVENTION

1. Field of the Invention

The present invention relates to a refrigerated container for receiving and storing materials, such as medical wastes, at a site, such as a hospital, for a relatively extended time, then transporting the materials to a disposal facility. The container is designed such that the materials can be dumped into a disposal facility, such as an incinerator, without the necessity of personnel coming into contact with the waste materials.

2. Background of the Invention

Hospitals and medical clinics generate large quantities of waste resulting from the medical services provided. Certain categories of these wastes present a health threat to individuals and to the community if the wastes are mishandled or allowed to escape into the environment. These wastes include liquids and solids, and contain residues of drugs, infectious agents, pathogens and other dangerous materials and instrumentalities associated with disease and its treatment.

Currently, such wastes are handled in a way which presents an opportunity for individuals to come into contact with the wastes and for the wastes to come into contact with the environment before disposal in an approved manner. For example, wastes which may be dangerous are collected in receptacles, such as plastic bags, at the sites where they are generated. These bags of wastes containing substantial organic matter and having liquid as well as solid components, are then placed in leak resistant containers and stored under refrigeration until disposed of. When sufficient wastes are accumulated in storage, the wastes are transported, by means such as a refrigerated truck, to a disposal facility, such as an incinerator. At the disposal facility, the wastes are unloaded from the transport means for disposal.

Substantial opportunities exist for wastes handled in the above manner to come into harmful contact with individuals and with the environment. The bags of waste are handled several times by individuals in the process of taking the wastes to storage, loading the stored wastes into the transport means, and unloading the wastes at the disposal facility. The bags may burst in storage or during transport, allowing harmful agents such as pathogens and other infectious agents, to come into contact with those individuals handling the wastes, or allowing harmful agents to escape into the environment.

DESCRIPTION OF PERTINENT ART

A variety of containers have been proposed for storing and transporting degradable, organic materials under refrigerated conditions.

Hazra, in U.S. Pat. Nos. 3,514,969; 3,650,120; and 4,044,569, discloses apparatus and methods for compressing refuse, freezing the compressed refuse, and storing the frozen compressed refuse for subsequent pick up by a refuse collector.

Connors, in U.S. Pat. No. 4,220,014, discloses apparatus for prolonged storage of garbage, which apparatus comprises an insulated container maintained at a temperature slightly above freezing into which increments of garbage are fed over an extended period of time. A refrigeration unit is positioned through the top wall of the container with the refrigeration unit evaporator extending into a perforated baffle within the container.

Fredrixon, in U.S. Pat. No. 4,561,262, discloses a top structure for a transport compartment formed of a pallet with a so-called pallet collar or the like, or another upwardly openable container, which structure is adapted to upwardly close the compartment and to maintain cold in the transport compartment. The new feature is that a tank or container for cooling or freezing medium in liquid state is accommodated in the top structure, said tank being provided with a permanently open nozzle through which cold, vaporized medium flows out into the compartment.

Negishi, in U.S. Pat. No. 4,928,501, discloses a cold preserving container including a goods container space; a dish-like member above the space; a cold accumulator enclosing a cold regenerative material disposed in the dish-like member (may be a refrigeration unit); a heat insulating wall forming an air path between the wall and the dish-like member; and a blower circulating air between the air path and the goods container space. The cold accumulator cools the air in the dish-like member, the cooled air can fall down into the goods container space and circulate between the space and the air path by driving the blower. Since the cooling of air in the goods container space is controlled by the drive control of the blower, the temperature of the inside air can be easily controlled and maintained at the desired temperature despite variations in outside air temperature. Moreover, since the cold accumulator is disposed in the dish-like member, a stable structure for the cooling portion of the container can be easily achieved, thereby providing a container suitable for long distance transportation.

Guilhem, in U.S. Pat. No. 4,958,506, discloses an isothermic container for transporting tissue grafts at a constant temperature of 4 degrees C. For this purpose, the container presents a thermal exchanger realizing a thermal flow between a thermal source constituted in particular by ice and water at about 0 degrees C, disposed preferably in the lid of the container, and a volume such as a peripheral enclosure. The peripheral enclosure may be a water jacket around the space for holding the grafts, and the thermal exchanger insures a thermal transfer between the thermal source at a constant temperature and the layer of water in the upper portion of the water jacket.

Takano, in U.S. Pat. No. 5,029,450, discloses a refrigerated commodities transport system comprising: a freight collecting device for collecting from a client commodities to be refrigerated, or commodities already refrigerated; a storing device including a refrigerating box for storing the collected commodities in a low temperature area; a delivering device for delivering the refrigerated commodities to a recipient. The refrigerating box comprises a freezing room and a storing room, and includes air blowers, a selecting section and a temperature control device which permits transportation, in only one refrigerating box, of refrigerated commodities in different temperature zones.

Thus, from the above, it can be seen that various approaches have been made to the recognized problem of storing and transporting degradable materials, such as wastes, refuse, or tissue grafts, under refrigeration. However, a container adapted to the particular requirements of storing and transporting medical waste is desirable. Such a container will be capable of receiving, storing and transporting medical wastes safely without leakage or escape of the waste from the container, and without necessity for any person to come into contact with the wastes after the wastes are placed in the container.

SUMMARY OF THE INVENTION

Now, according to the present invention, an improved container for storing and transporting contaminated waste materials, such as medical wastes, is disclosed.

An object of the invention is to provide a container which is refrigerated and insulated for preventing spoilage of bio-degradable materials during storage and transportation.

Another object of the invention is to provide a container which is closable to preventing infectious agents or other hazardous or noxious materials from escaping from the container into the environment.

Another object of the invention is to provide a container in which waste materials can be stored, transported and disposed of at a disposal site without necessity for personnel handling the container to come into contact with the waste materials.

Another object of the invention is to provide a refrigerated container which may be cleaned with hot water, steam and/or chemical disinfectants without affecting the container, its insulation or its refrigeration means.

These and other objects and advantages of the present invention will become apparent from a consideration of the following detailed description and the attached drawings.

BRIEF DESCRIPTION OF THE DRAWINGS

FIG. 3 is a schematic representation of section A—A through the container of FIG. 1, showing the circulation pattern of refrigerated air through an annular space in the container.

FIG. 4 is a schematic representation of section B—B through the container of FIG. 1, showing the circulation pattern of refrigerated air through the annular space in the container.

FIGS. 5A, 5B and 5C are a series of schematic representations showing the process of inverting the container to dump waste therefrom, and then righting the inverted container.

DESCRIPTION OF A PREFERRED EMBODIMENT

The detailed description which follows is for a preferred embodiment and illustrates the principals and improvements of the present invention. It is, however, to be understood that this detailed description is not to be taken in a limiting sense, and that no limitations to the scope of the invention are intended except those limitations contained in the appended claims.

Figure 1:
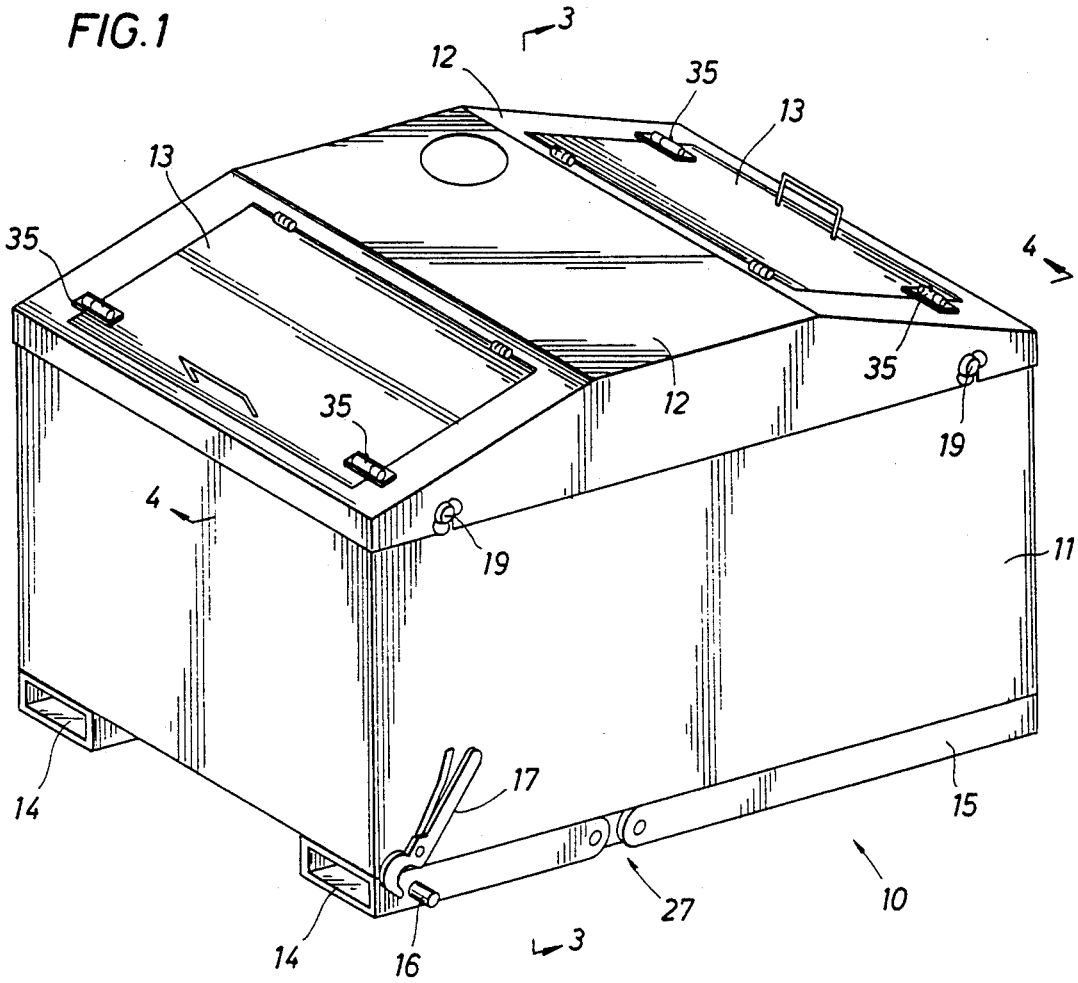
FIG. 1 is schematic representation of an isometric view of a container representing a preferred embodiment of the present invention.

In FIG. 1, a container for storing and transporting contaminated waste materials, and embodying the improvements of the present invention is indicated generally by 10. Container 10 comprises an outer box 11 and a lid 12. Lid 12 has access doors 13 for providing access into the interior of container 10. Outer box 11, lid 12 and access doors 13 are preferably of steel or other similar strong material, such as engineering plastics, which can withstand service as a waste container.

Lid 12 covers the top of outer box 11, and lid 12 and box 11 are releasably attached by attachment means 19. Attachment means 19 may be any convenient attachment means, such as wing nuts and stud bolts, which can be readily engaged or disengaged for rapid attachment and release of lid 12 to outer box 11. It is contemplated that lid 12 will be firmly attached to outer box 11 when waste materials are being stored or transported, for preventing spillage or leakage of waste materials from box 11. Further it is contemplated that lid 12 will be removed when waste materials are dumped from box 11 into a disposal facility to protect lid 12 from damage in the dumping process.

Access doors 13 are opened for depositing waste materials within container 10, and closed for preventing noxious or infectious materials from entering into the environment. Preferably, doors 13 may be sealingly closed and locked for preventing spillage or leakage of waste materials during transportation of container 10.

Outer box 11 rests upon and is rigidly attached to elongated support members 15. Support member 15 is preferably comprised of structural materials, such as steel channels, which provide mechanical support for box 11.

Outer box 11 also rests upon lifting members 14. Lifting members 14 are preferably comprised of steel structural members, such as steel boxes, adapted for engagement with lifting means (not shown) such as the tines of a fork-lift truck. Lifting members 14 are in longitudinal alignment with support member 15, and members 14 and 15 are connected by hinge member 27.

Latch pin 16 is rigidly attached to lifting member 14, and latch means 17 is rotatably attached to box 11. Latch means 17 is adapted for releasable engagement with pin 16. Upon engagement of latch means 17 and pin 16, lifting members 14 is connected to box 11, such that upon elevation of lifting members 14 (as with a fork-lift truck), box 11 will be likewise elevated in a horizontal position. Upon disengagement of latch means 17 and pin 16, elevation of lifting members 14 causes box 11 to tilt forward and downward, rotating about hinge 27. Continued elevation of lifting member 14 results in box 11 tilting into an inverted position for dumping waste materials from box 11, as is shown more clearly in FIGS. 5A–C and described below.

Container 10 of FIG. 1 has internal members for containing waste materials under refrigeration during storage and transportation. Internal construction of the preferred embodiment of container 10 is shown in detail in drawings FIGS. 2A and 2B which are, taken together, a schematic representation of an exploded view of container 10.

Figure 2A:
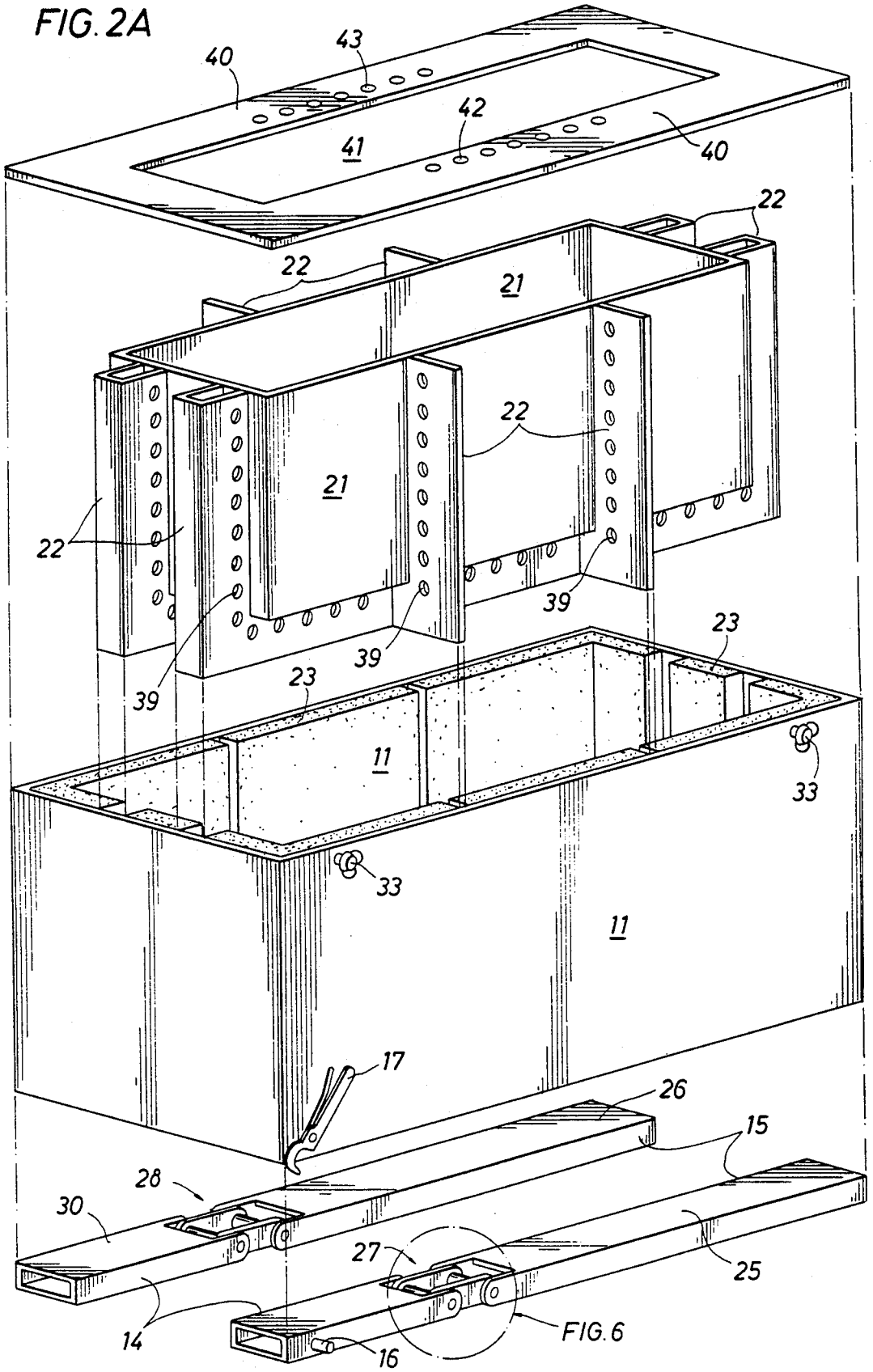
FIGS. 2A and 2B together are a schematic representation of an exploded view showing the elements which comprise the container of FIG. 1.

In FIG. 2A, inner box 21 is provided for holding waste materials during storage and transportation. Inner box 21 has an open top, and has solid side walls and bottom, preferably of a non-corrosive material, such as stainless steel or an engineering plastic, which will hold waste materials without leakage and will withstand cleaning and disinfecting with hot water, steam and/or chemical cleaning and disinfecting agents. Inner box 21 fits within outer box 11 such that outer side walls and bottom of inner box 21 are in spaced apart relation to the inner side walls and bottom of outer box 11, forming an annular space 38 therebetween for circulation of refrigerated air, as shown in FIGS. 3 & 4 and described below.

Spacer members 22 are in engagement with outer walls and bottom of inner box 21 and in engagement with inner walls and bottom of outer box 11 for maintaining the annular space 38 between inner box 21 and outer box 11. Spacer member 22 define openings 39 which provide channels for circulation of refrigerated air through annular space 38, as shown in FIGS. 3 and 4 and described below. Spacer members 22 are of a rigid material, such as steel or engineering plastic structural members, for example, angled or channel members. Openings 39 are near the walls and bottom of inner box 21 for aiding contact of refrigerated air with box 21 and for avoiding any interference of outer box insulation 23 with openings 39, as described below.

In FIG. 2A, an annular space cover plate 40, having a central opening 41, refrigerated air openings 42 and return air openings 43, is in sealing engagement with the top of outer box 11 and the top of inner box 22 for closing the top of annular space 38. Opening 42 is of substantially the same dimensions as the open top of inner box 21 for allowing free access into the interior of box 21. Cover 40 is preferably of a strong corrosion resistant material, such as stainless steel or an engineering plastic. The sealing engagement of cover 40 with the tops of boxes 11 and 21 may be by any convenient means, such as welding. Openings 42 for refrigerated air and openings 43 for return air provide communication for circulation of air from a refrigeration unit 90 located in lid 12, through annular space 38, all as shown in FIGS. 3 and 4 and described below.

In FIG. 2A, outer box 11 inner walls and bottom are insulated with insulation material 23 for substantially reducing heat flow from the environment through the walls or bottom of box 11 into the refrigerated air circulating in annular space 38. Insulation 23 may be any effective thermal insulation material, such as fiberglass, cork or foam polymer, which will withstand the temperatures of steam and withstand contact with disinfecting chemicals employed to clean the container. Preferably, the exposed surfaces of insulation 23 is covered with protective material, such as a shield of thin metal or other impervious material, for preventing absorption of fluids or particulate material, including microbiological materials, from the circulating air and for protecting the insulation 23 from damage by cleaning agents. Where insulating material 23 is polymer foam, a particularly preferred protective material is the impervious skin of polymer formed on the surface as the foaming polymer expands.

In FIG. 2A, support member 15 is comprised of parallel, elongated structural members 25 and 26 which are rigidly connected to the bottom of outer box 11, as by welding or other suitable means. Lift member 14 is comprised of parallel, elongated structural box or channel members 29 and 30. Lift member 29 is in axial alignment with support member 25 and the two members are rotatably connected by hinge 27. Lift member 30 is in axial alignment with support member 26, and the two members are rotatably connected by hinge 28. Hinges 27 and 28 are in axial alignment with one another, and are located horizontally off-center with respect to the vertical center line of container 10, such that as lift member 14 is elevated container 10 will rotate downward about the common axis of hinges 27 and 28 until container 10 is inverted and the open top of inner box 21 is directed downward.

Latch pin 16 is rigidly attached to lift member 14. Latch member 17 is rotatably attached to outer box 11. With container 10 upright and resting upon lift member 14, latch member 17 may be releasably engaged with latch pin 16 thereby attaching container 10 to lift member 14. Upon lifting member 14 with latch 17 and pin 16 engaged, container 10 will not rotate about hinges 27 and 28 and may be lifted off the ground for movement to a new location. However, upon release of latch 17 from latch pin 16, container 10 is then released from attachment to lift member 14 and container 10 will rotate about hinges 27 and 28 into an inverted position, as described above.

Figure 6:
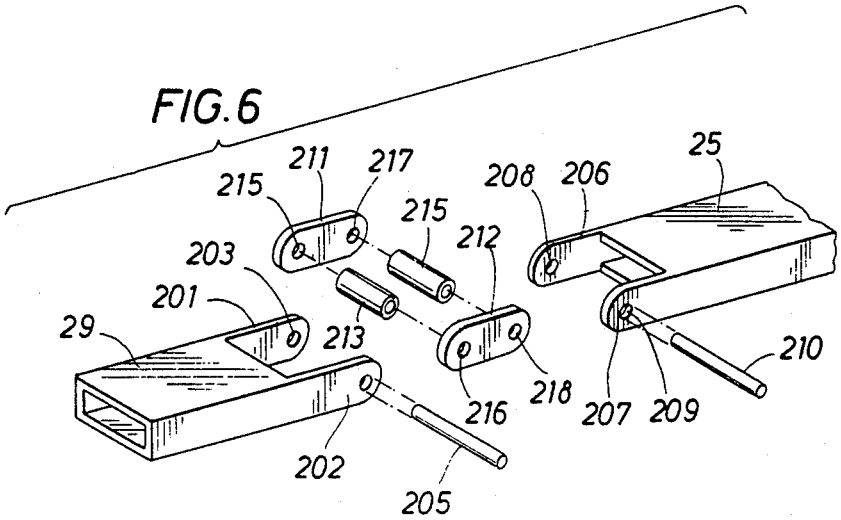
FIG. 6 is detail C of FIG. 2A, showing details of the hinged connection between the container and the lift member.

FIG. 6 is detail C of FIG. 2A, and is a schematic representation of a detailed exploded view of hinge 27. FIG. 6 is typical for both hinges 27 and 28, and the following description applies equally to either hinge. In FIG. 6, member 29 of lift member 14 terminates in parallel flanges 201 and 202, having coaxial openings 203 and 204, respectively. Hinge pin 205 engages flanges 201 and 202 through openings 203 and 204. Member 25 of support member 15 terminates in parallel flanges 206 and 207 having coaxial openings 208 and 209 respectively. Hinge pin 210 engages flanges 206 and 207 through openings 208 and 209. Hinge member 18 comprises parallel plate 211 having openings 215 and 217, and parallel plate 212, having openings 216 and 218. Parallel plates 211 and 212 are separated by open tubular members 213 and 214. Opening 216 in plate 212 is in coaxial alignment with tubular member 213 and with opening 215 in plate 211. And opening in plate 218 in 212 is in coaxial alignment with tubular member 214 and opening 217 in plate 211.

Upon assembly of hinge 27, hinge plate 212 fits inside flanges 202 and 207 such that openings 204 and 216 are aligned, and openings 209 and 218 are aligned. Likewise, hinge plate 211 fits inside flanges 201 and 206 such that openings 203 and 215 are aligned, and openings 208 and 217 are aligned. Hinge pin 205 is passed through flange opening 204, plate opening 216, tubular member 213, plate opening 215 and flange opening 203 to form a first hinge 31. (Shown in FIG. 2A as typical for both hinges 27 and 28). Hinge pin 201 is then passed through flange opening 209, plate opening 218, open tubular member 215, plate opening 217, and flange opening 208 for forming second hinge 32. (Shown in FIG. 2A as typical for both hinges 27 and 28).

Figure 2B:
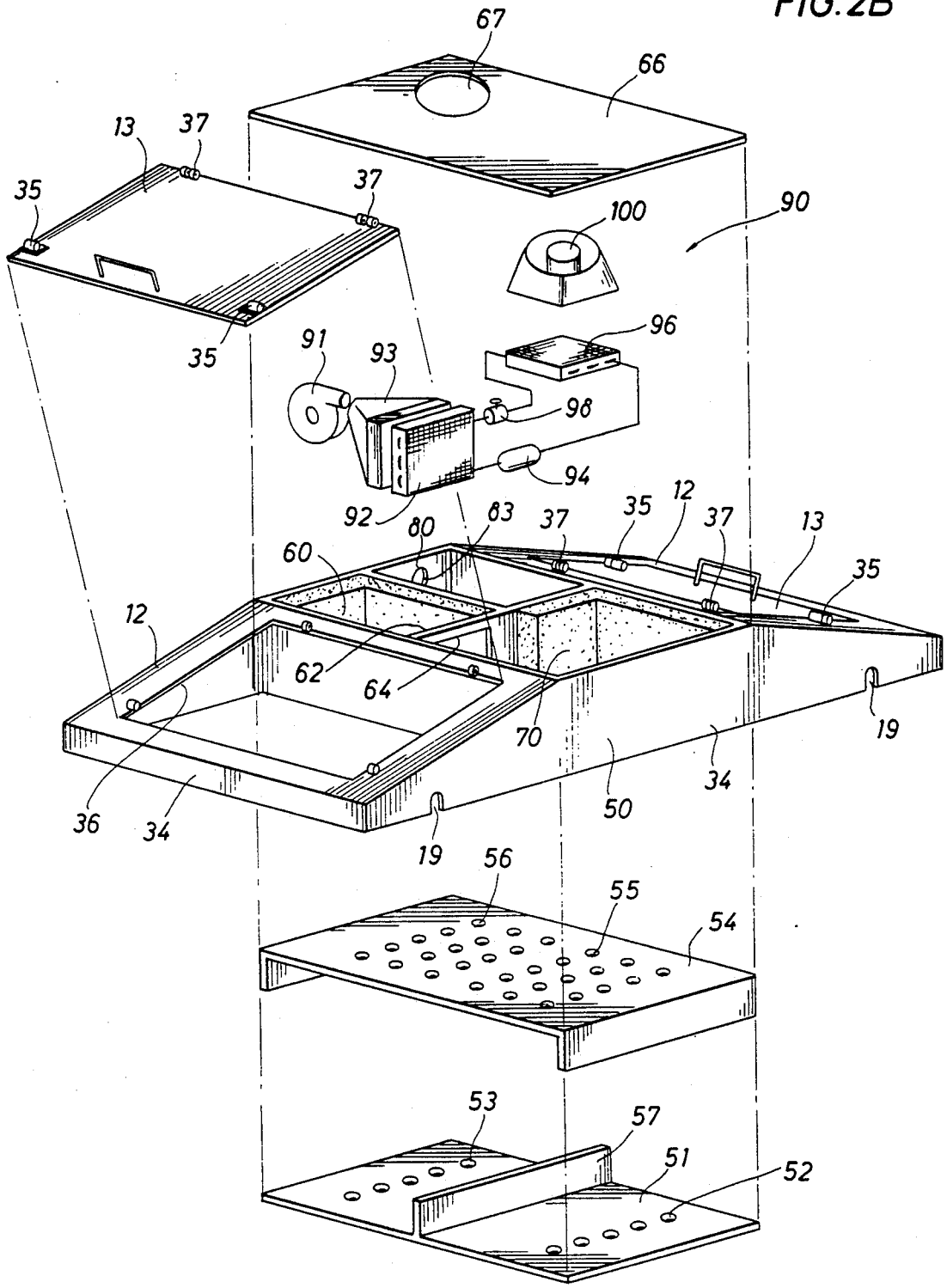

In FIG. 2B, lid 12 fits the top of outer box 11 for covering the open top of inner box 21. Lid 12 also houses a refrigeration unit 90 for refrigerating circulating air, as is described below. Lid 12 is releasably attached to the top of outer box 11 by any convenient attachment means, such as a notched flange member 34 fitting over wing bolt 33 which is threadingly attached to outer box 11. Lid 12 is connected to outer box 11 by tightening bolts 33 until the flange portion 34 of lid 12 is held by compression between the head of the bolt 33 and the wall of box 11. Lid 12 has openings 36 for receiving access doors 13. Access doors are attached to lid 12 with hinges 37 such that access doors 13 may be opened for providing access into the interior of inner box 21, and may be closed to prevent communication between the interior of box 21 with the environment. Access doors 13 may be latched closed using through bolts 35 to prevent spillage or leakage of waste materials as container 10 is employed for transportation of waste materials to a disposal facility.

Lid 12 has a compartment 50 with subcompartments for housing air refrigeration unit 90 and for directing flow of circulating air through refrigeration unit 90.

In FIG. 2B, the bottom of compartment 50 is comprised of a first plate member 51 having refrigerated air openings 52 and return air openings 53. When lid 12 is engaged with outer box 11, refrigerated air opening 52 are in register with refrigerated air openings 42 in annular space cover 40, and likewise, return air openings 53 in plate 51 are in register with return air openings 43 in annular space cover 40. The openings 52 and 42 and 53 and 43 provide a circulating air path through annular space 38 and compartment 50.

In FIG. 2B, second bottom plate 54 is spaced vertically above and parallel to first plate 51, forming a bottom space in compartment 50. Separation member 57 is sealingly attached across compartment 50 between first plate 51 and second plate 54 for separating the bottom space of compartment 50 into a lower refrigerated air chamber 58 and a lower return air chamber 59 (shown more clearly in FIG. 3 of the drawing). Wall members 61 and 62 divide the portion of compartment 50 above second plate 54 into an upper return air chamber 60 and upper refrigerated air chamber 70 and subcompartment 80. Third plate 66, having an exhaust air opening 67, is in sealing engagement with the top of compartment 50 for enclosing chamber 60 and 70 and subcompartment 80.

In FIG. 2B, plate 54 has openings 56 which provide communication between lower return air chamber 59 and upper return air chamber 60, and has openings 55 which provide communication between upper refrigerated air chamber 70 and lower refrigerated air chamber 58. Wall 61 of upper return air chamber 60 has opening 62 for housing refrigerator expansion coil 92.

In FIG. 2B, refrigeration unit 90 is a conventional expansion refrigeration unit employing a commercial refrigerant fluid. Refrigeration unit 90 comprises an air circulation fan 91, air plenum 93, expansion coil 92, refrigerant compressor 94, condensing coil 96, expansion valve 98, and cooling fan 100. Refrigeration unit 90 also contains appropriate conventional temperature and pressure controls and electrical connections (not shown) required for proper operation. The capacity and design of refrigeration unit 90 will be dictated by the size and capacity of inner box 21 and by the quality of insulation 23 employed in construction of container 10. However, in general, refrigeration units of about 1 to 3 tons capacity will be suitable for containers of about 125–250 cubic feet capacity (where a container 4'×4'×8' has a capacity of 128 cubic feet).

In FIG. 2B, circulation fan 91 and plenum 93, housed in upper return air chamber 60, are in communication with the air side of expansion coil 92. Expansion coil 92 is mounted in opening 64 in wall 62 between chamber 60 and upper refrigerated air chamber 70, thus providing a communication path for return air from chamber 60, through the air side of coil 92 where air is refrigerated, into upper refrigerated air chamber 70. Refrigeration unit compressor 94, condenser 96, and cooling fan 100 are housed in subcompartment 80. In operation, condenser cooling fan 100 draws ambient air through opening 83 in wall 82 of subcompartment 80, passes the air across the coils of condenser 96 for cooling the compressed refrigerant, and exhausts the heated air through opening 67 in top plate 66.

Expansion valve 98 is in communication with condensing coil 96 and expansion coil 92 for expanding and cooling condensed refrigerant as it enters expansion coil 92.

OPERATION OF CONTAINER FOR REFRIGERATING STORED WASTE

In FIGS. 3 and 4, container 10 of the present invention is shown in sectional views A—A and B—B, respectively, of FIG. 1. Circulating air flow is shown by arrows.

In this preferred embodiment of the present invention, refrigerated air is the preferred heat exchange fluid for cooling box 21 and the waste materials contained therein. Air, cooled by conventional refrigeration unit 90 located in lid 12, is circulated through the chambers in lid 12 and the annular space 38 in the lower portion of container 10 for contact with outer walls and bottom of inner box 21. Heat from waste materials contained in box 21 flows through the uninsulated walls of box 21 and is absorbed by the cold circulating air.

With air as the heat transfer fluid, lid 12, containing refrigeration unit 90, may be easily removed from the top of outer box 11 without any special care. The circulating air presents no environmental hazards therefore there is no necessity for taking steps to prevent such air from entering the environment. Removal of lid 12 from box 11 also removes the refrigeration unit 90, which contains volatile liquids under high pressure, from the lower portion of container 10. Thus, the lower portion of container 10, comprising inner box 21 and outer box 11, may conveniently be cleaned with steam and/or chemical disinfectants without danger of overheating and rupturing portions of refrigeration unit 90 which contain volatile high pressure fluids. Also, since air is circulated at substantially atmospheric pressure within annular space 38, no high pressure systems which may rupture if overheated exists in container 10 when lid 12 is removed. Therefore, use of steam in cleaning inner box 21 and outer box 11 will not create a hazard from ruptured high pressure tubing or escaping refrigerant gasses.

In FIGS. 3 and 4, inner box 21 is supported with an outer box 11 by spacer members 21 thereby forming an annular space 38 between the outer walls and bottom of inner box 21 and the inner walls in bottom of outer box 11. Lid 12 fits over the top of outer box 11, such that access to the interior of box 21 may be had through access doors 13. Preferably, insulation 23 is placed on interior surfaces of box 11, lid 12, and access doors 13 for preventing the flow of ambient heat into the circulating air and the interior of box 21. Insulation 23 may be selected from fibrous (such as fiberglass), or solid (such as cork) or foam polymer (such as foam-in-place polyurethane) which will provide thermal insulation for circulating air in box 21, and which insulation 23 will withstand temperatures and chemicals employed for cleaning container 10. The thickness of insulation will be determined by the insulating value required to maintain the desired temperature within box 21 at an economical cost. Particularly preferred, is insulation 23 comprising foam-in-place polyurethane having a self-formed impermeable polymer skin. Insulation 23 on walls and bottom of outer box 11 occupies only a portion of the space between outer box 11 and inner box 21, and the remainder of the space, which is open, comprises the annular space 38 in which refrigerated air circulates.

In FIGS. 3 and 4, return air in annular space 38, having absorbed heat from inner box 21, flows upward through openings 43 in plate 40 and openings 53 in plate 51 into return air lower chamber 59. From chamber 59, return air flows through openings 56 in plate 54 into return air upper chamber 60. In upper chamber 60, air circulation fan 90 blows return air through plenum 93 into refrigeration unit expansion coil 92 where the air is cool to the desired refrigerated air temperature for use in cooling materials stored in inner box 21. From expansion coil 92, the refrigerated air flows into refrigerated air upper chamber 70, through openings 55 and floor plate 54 into lower refrigerated air chamber 58. From chamber 58, refrigerated air is distributed through openings 52 in plate 51 and openings 42 in cover plate 40 into annular space 38 between the walls of inner box 21 and walls of outer box 11. The walls and bottom of outer box 11 are insulated with thermal insulation 23 for reducing the transfer of heat from the environment into the refrigerated air in annular space 38.

Spacer members 22 maintain inner box 21 in spaced apart relation to outer box 11, and thereby define annular space 38. Spacer members 22 have openings 39 for channeling refrigerated air through annular space 38 for heat exchanging contact with the walls and bottom of inner box 21 for cooling box 21 and its contents. The absorbed heat warms the circulating air. The warm circulating air, as return air, flows from annular space 38 through openings 43 in plate 40 and openings 53 in plate 51 into the lower return air chamber 59 from which the air is cooled and recirculated as refrigerated air, as described above.

In FIGS. 3 and 4, the circulating air does not contact either the interior of inner box 21 or the waste materials contained therein. This arrangement helps prevent the spread of infectious or noxious materials from the waste materials into refrigeration system 90 or into the atmosphere and environment outside container 10. This arrangement thus eliminates a vector by which disease may be spread.

In FIGS. 3 and 4, lid 12 fits over the top of outer box 11, as described above with reference to FIGS. 2A and 2B. Access doors 13 are mounted on lid 12 preferably forming a leak resistant seal when closed. During periods when container 10 is being used to store waste materials, additional waste materials for storage are deposited through access doors 13. When waste materials are being transported in container 10, access doors 13 are preferably latched closed, as with bolts 35, to prevent leakage or spillage of waste from the container 10 in the event of an accident. Lid 12, with refrigeration system 90, is easily removed from the top of container 10 by releasing attachment means 19, which hold lid 12 to box 11, and then lifting lid 12 clear and free of box 11. Removal of lid 12 at the waste disposal site aids in removal of waste materials from container 10. Also, container 10, with lid 12 and refrigeration system 90 removed, may be cleaned and disinfected with steam and chemical disinfectants which otherwise might damage refrigeration system 90.

OPERATION FOR DUMPING WASTE FROM THE CONTAINER

FIGS. 5A-5C are schematic representations showing an operation of lifting and dumping container 10, employing a fork-lift truck, shown in ghost outline, as the lifting means. This illustrates one advantage of container 10 of the present invention, where waste materials kept under a state of refrigeration can be dumped at a waste disposal facility without necessity of any person coming into physical contact with the waste materials. This advantage removes another vector for spread of disease from the waste materials.

In FIG. 5A, container 10 is shown with lid 12 in place on outer box 11, and with latch means 17 on box 11 engaged with latch pin 16 on lift member 14. The fork-lift tines are inserted into lift member 14. With latch means 17 and latch pin 16 engaged, container 10 is lifted above the earth's surface 45 by raising the fork-lift tines, and container 10 may be moved to a designed location, such as into a truck trailer for transportation, or out of the trailer at a waste disposal site. At the disposal site, attachment members 19 are released and lid 12, containing refrigeration unit 90 (not shown), is removed and set aside.

In FIG. 5B, container 10 with lid 12 removed has been moved to a waste disposal pit 46, and latch member 17 released from engagement with latch pin 16. Container 10 has rotated forward about hinge 27, until container 10 is inverted with its center of gravity 47 in vertical alignment with hinge point 205 on lift member 14. With container 10 inverted, the open top of box 21 faces downward and waste materials dump out into disposal pit 46 without necessity of a person physically contacting the waste materials. Conveniently, container 10, including the inside of inner box 21, may be cleaned and sterilized with steam and/or disinfecting chemicals while in this inverted position. Condensate and excess chemicals may then drain out of the inner box 21.

In FIG. 5C, container 10 has been lowered until its inverted end has contacted surface 45 and the fork-lift truck has backed up, causing container 10 to tilt back toward a horizontal position. This action will continue as the fork-lift truck continues to back up and lower its tines, until container 10 is horizontal and resting upon lift member 14. Latch member 17 may then be reengaged with latch pin 16, and lid 12 reattached to the top of box 11 in preparation for returning the clean container 10 to service in receiving and storing waste materials.

While the present invention has been described with particular emphasis upon a preferred embodiment and with reference to the attached drawings, it is to be understood that various modifications, alterations and changes in configuration can be made which are within the spirit and scope of the invention defined in the appended claims, and that no limitation of the invention is intended except limitations contained in the appended claims.

I claim:

1. An insulated container for storing, transporting and disposing of waste materials, comprising:

a) a waste material holding inner box, having closed bottom and sides to prevent leakage of liquid or solid waste therefrom, and having an upper access opening for admitting and removing waste materials;

b) air channel means in heat exchanging contact with the inner box, having a refrigerated air inlet and a return air outlet;

c) refrigeration means releasably attached to the container and in communication with the air channel means for refrigerating and circulating air through the air channel means to cool the inner box and the materials contained therein;

d) Access cover means attached to the container for opening to admit waste materials and for closing to shut the interior of the inner box from communication with the atmosphere and environment surrounding the container;

e) Access cover locking means for locking the access cover to the container, in a closed position for preventing waste materials from leaking or spilling from the container during transportation; and f) lifting means attached to the container adapted for engagement with a lifting device to invert the container and dump waste materials from the inner box through the access opening without necessity of personnel physically contacting the waste materials being removed.

2. The container of claim 1, including: access cover means comprising a lid member releasably attached to the container and having access doors.

3. The container of claim 2 when the lid member is removable from the container.

4. The container of claim 3, wherein the refrigeration means is attached to the releasably attached lid member, and wherein the lid member defines a return air chamber having communication with the air channel return air outlet and with the refrigeration means, and defines refrigerated air chamber having communication with the refrigeration means and with the air channel refrigerated air inlet, for providing a path for the flow of refrigerated air through the refrigeration means and the air channel in heat exchange contact with the inner box.

5. The container of claim 4, including;

an insulated outer box, having bottom and side walls and an open top, surrounding, and in spaced apart relation to the inner box, defining an annular space therebetween;

an annular cover plate sealingly engaged with the top of the outer box and the top of the inner box and closing the top of the annular space, having a central opening providing access into the inner box, having refrigerated air openings in communication with the annular space, and having return air openings in communication with the annular space, wherein, the refrigerated air openings are in communication with the refrigerated air chamber, and the return air openings are in communication with the return air chamber, and the air channel.

6. The container of claim 5 including: spacer members comprising elongated structural members attached to the outer walls of the inner box and the inner walls of the outer box within the annular space, and having openings for distribution of refrigerating air within the annular space.

7. The container of claim 6, including: the lifting device engagement means comprising two elongated tubular members adapted for engagement with a lifting device, and rotatably attached to the bottom of the outer box; a latch pin connected to a tubular member; a latch means connected to the outer box for releasable engagement with the latch pin; wherein, with the latch means and latch pin engaged, the outer box will not rotate with respect to the lifting device engagement means; and with latch means and latch pin disengaged, the outer box will rotate into an inverted position as the container is elevated vertically by a lifting device engaged with the lifting device engagement means.

8. In a method where waste materials are deposited, stored and transported under refrigeration in an inner box portion of an insulated container wherein the inner box has an access opening, and the container has an access opening cover, the improvement which comprises:

a) providing the container with a refrigeration unit and with an air circulation channel in indirect heat exchange communication with the inner box;

b) cooling the waste materials in the inner box portion of the container by circulating refrigerated air from the refrigeration unit through the air circulation channels;

c) opening the access opening cover to admit or remove waste materials from the inner box portion of the container;

d) closing the access opening cover to prevent leakage or spillage of waste material from the container during storage and transportation; and e) opening the access cover and inverting the container until the access opening faces downward for disposal of waste materials from the inner box.

9. The method of claim 8 including: providing the container with a lid containing the access opening cover and the refrigeration unit, and removing the lid, including the access opening cover and refrigeration unit, before inverting the container.

* * * * *